United States Patent [19]

Lopata

[11] Patent Number: 4,891,023

[45] Date of Patent: Jan. 2, 1990

[54] CIRCUIT CARD EDGE CONNECTOR AND TERMINAL THEREFOR

[75] Inventor: John E. Lopata, Naperville, Ill.

[73] Assignee: Molex Incorporated

[21] Appl. No.: 234,770

[22] Filed: Aug. 22, 1988

[51] Int. Cl.[4] ..... H01R 23/70

[52] U.S. Cl. ..... 439/637; 439/62; 439/746

[58] Field of Search ..... 439/741, 744, 745, 751, 439/746–749, 79, 81–84, 816, 842, 858, 59–62, 629, 630, 632, 636, 637

[56] References Cited

U.S. PATENT DOCUMENTS

| | | | |
|---|---|---|---|
| 3,173,737 | 3/1965 | Kinkaid et al. | 439/746 |
| 3,422,394 | 1/1969 | Antes | 439/637 |
| 3,579,176 | 5/1971 | Bokor | 439/633 |
| 3,989,344 | 11/1976 | Pechard et al. | 439/637 |
| 4,699,595 | 10/1987 | Nakazawa et al. | 439/676 |

FOREIGN PATENT DOCUMENTS

| | | | |
|---|---|---|---|
| 2259774 | 6/1974 | Fed. Rep. of Germany | 439/637 |
| 0005554 | 2/1973 | Japan | 439/637 |
| 274812 | 9/1964 | Netherlands | 439/637 |

*Primary Examiner*—David Pirlot

*Attorney, Agent, or Firm*—Louis A. Hecht; Stephen Z. Weiss

[57] ABSTRACT

An edge connector is provided comprising a housing and a plurality of stamped and formed terminals mounted therein. The housing is constructed to be self-compensating for variations in the thickness of a printed circuit board and the location of mounting apertures therein. The housing includes a plurality of terminal receiving cavities, each of which includes an internally disposed latch wall. The terminals each include a base, a solder tail extending from one side of the base and a contact beam and mounting beam cantilevered from the opposite side of the base. The mounting beam includes a mounting arm and a latch arm cantilevered from the mounting arm and disposed intermediate the mounting arm and the contact beam. The latch arm is resiliently deflectable to lockingly engage the centrally disposed latch wall of the housing, and to thereby minimize outwardly directed pressure on the external walls of the housing that could otherwise bow the housing and minimize the effectiveness of the connector.

20 Claims, 3 Drawing Sheets

CIRCUIT CARD EDGE CONNECTOR AND TERMINAL THEREFOR

BACKGROUND OF THE INVENTION

Edge connectors are employed to achieve electrical connection to the conductive portion along an edge of a printed circuit card. More particularly, the card may include an array of circuitry printed or otherwise disposed thereon. The various circuits will terminate along one edge at exposed generally equally spaced conductive portions. Circuit cards have been miniaturized in recent years, and in many currently employed circuit cards the conductive strips disposed along the edge thereof are at 0.050 inch center to center spacings.

The edge connector comprises a housing constructed to mount on a printed circuit board, panel or other such structure, and having a slot for receiving the edge of the circuit card that has the conductive portions equally spaced therealong. A plurality of terminals are securely mounted in the edge connector housing at spacings that substantially correspond to the spacings of the conductive portions along the edge of the circuit card. More particularly, the terminals are mounted in the housing of the edge connector to make electrical contact with the conductive portions of the circuit card upon insertion of the circuit card into the slot of the edge connector housing. Each terminal will further include structure for achieving electrical connection to other circuitry on the printed circuit board, panel or other structure to which the edge connector housing is mounted. For example, each terminal mounted in the edge connector may comprise a solder tail which can be soldered to conductive strips on a printed circuit board to which the edge connector housing is mounted.

The prior art edge connectors have largely relied upon terminals which are either force fit or lockingly retained in the housing of the edge connector. For example, the prior art terminals of an edge connector may include members that are resiliently disposed in spaced relationship to one another. As this prior art terminal is urged into a cavity of the edge connector, the spaced apart members of the terminal are urged toward one another and exert a resilient biasing force against walls of the edge connector housing to retain the terminal therein. Other prior art edge connector terminals are constructed with resilient latch members that are adapted to engage an externally disposed wall of the housing to lockingly retain the edge connector terminal therein. Still other prior art edge connectors include combinations of these structures such that a latch mechanism will determine the longitudinal position of a terminal in an edge connector housing, and such that the resilient force fitting of two spaced apart members of the terminal will substantially prevent movement of the terminal within the housing.

One example of a prior art edge connector and a terminal therefore is shown in U.S. Pat. No. 4,558,912 which issued to Coller et al. on Dec. 17, 1985. The terminal shown in the edge connector of U.S. Pat. No. 4,558,912 includes a resiliently deflectable latch member which lockingly engages a ledge adjacent an outer wall of the edge connector housing to align and retain the terminal in the housing. Other edge connector terminals with latch means for lockingly engaging a ledge on an external wall of the housing are shown in: U.S. Pat. No. 4,322,120 which issued to Rilling on Mar. 30, 1982; U.S. Pat. No. 3,731,259, which issued to Occhipinti on May 1, 1973; and U.S. Pat. No. 3,421,136 which issued to Bowley et al on Jan. 7, 1969. Certain of the edge connectors and terminals shown in these references also rely to some extent upon the force fit engagement of the terminals in the electrical connector housing.

One edge connector terminal that relies substantially more on the force fit positioning of the terminal in the housing is shown in U.S. Pat. No. 3,400,360 which issued to Schmitt et al. on Sept. 3, 1968. In the Schmitt reference, the edge connector terminal is biasingly retained in the edge connector housing by resiliently deflecting a pair of cantilevered arms between opposed external walls of the edge connector housing. A similar force fit retention of an edge connector terminal in its housing is shown in U.S. Pat. No. 4,619,495 which issued to Sochor on Oct. 28, 1986 and which relies upon the forces exerted on the external walls of the edge connector housing by the cantilevered contact arms of the respective terminals. Still another similar force fit arrangement of an edge connector terminal in its housing is shown in U.S. Pat. No. 3,543,226 which issued to LaBoue on Nov. 24, 1970.

Other edge connectors that rely upon a complex inter-engagement of terminals within the respective housings are shown in U.S. Pat. No. 3,868,166 which issued to Ammon on Feb. 25, 1975 and in U.S. Pat. No. 4,026,014 which issued to Sugimoto et al on May 31, 1977.

The above-described prior art is considered undesirable in several important respects. First, it has been found that the forces exerted by closely spaced terminals (e.g., 0.050 inch spacings) on the external walls of the edge connector housing can cause the housing to bow. The bowing of the housing in response to outward forces exerted by the closely spaced terminals typically causes a loose mounting of the terminals disposed intermediate the opposed longitudinal ends of the edge connector housing. This loose mounting of centrally disposed terminals in the prior art edge connector housing can result in poor electrical connection to conductive portions of the card inserted therein.

The known edge connectors that do not rely on either a latched engagement of the terminals therein or a force fit engagement of the terminals therein also provide relatively imprecise positioning of the terminals relative to the card inserted therein. Thus, certain of these prior art terminals may make poor electrical contact with conductive portions of the card, particularly if those conductive portions are small and closely spaced.

One particularly effective edge connector is shown in co-pending U.S. patent application Ser. No. 046,375, entitled "DOUBLE SIDED EDGE CONNECTOR" which was filed by Paul L. Rishworth and Alan S. Walse on May 4, 1987, and which is assigned to the assignee of the subject invention. The edge connector of U.S. patent application Ser. No. 046,375 is particularly effective for circuit cards having closely spaced conductive portions thereon. The edge connector shown in the co-pending application includes a housing formed from hermaphroditic housing halves with terminals heat staked in their respective housing halves prior to assembly of the housing halves to one another. The heat staking of the terminals to their respective housing halves ensures precise alignment of the terminals without the complex and undesirable force fitting and latching which had been employed in the above-described prior art. Although the edge connector shown in the above-described co-pending application has proved particularly effective, it is often desirable to provide an edge connector with a unitary housing and without the requirement of heat staking or otherwise securing the terminals to the housing.

In view of the above, it is an object of the subject invention to provide an edge connector for achieving effective electrical connection to a circuit card having closely spaced conductive portions thereon.

It is another object of the subject invention to provide an edge connector having a unitarily molded housing with closely spaced electrical terminals securely mounted therein.

It is an additional object of the subject invention to provide an edge connector where the terminals therein do not significantly bow the walls of the edge connector housing.

Still a further object of the subject invention is to provide a terminal for an edge connector that achieves secure mounting in the edge connector housing and that achieves superior electrical contact with the conductive portions of a circuit card.

SUMMARY OF THE INVENTION

The subject invention is directed to an edge connector comprising a nonconductive housing and a plurality of electrically conductive terminals securely mounted therein. The housing may be unitarily molded from a plastic material. The housing comprises opposed external side walls, a top, a bottom and a slot extending into the top for receiving the edge of a circuit card. A plurality of cavities are disposed intermediate the external side walls for receiving the terminals therein. The cavities extend to the slot from opposite sides for double sided edge connection. The edge connector housing is molded such that each terminal cavity therein comprises an internally disposed latch wall for lockingly engaging a terminal as described below.

Each terminal of the edge connector housing may be stamped from a unitary piece of metallic material. More particularly, each terminal may comprise a base which is dimensioned to be received within a portion of the cavity in the edge connector housing. A solder tail or similar connecting means may extend from one side of the base of the terminal. The terminal further comprises a cantilevered contact beam and a cantilevered mounting beam both of which may extend from the base. The contact beam may define an elongated structure having an arcuate convex contact portion at a location along the contact beam to be disposed within the card receiving slot of the edge connector housing. More particularly, the contact beam is constructed to be resiliently deflectable upon insertion of the circuit card into the card receiving slot of the edge connector housing.

The mounting beam of the terminal may be disposed in spaced relationship to the contact beam such that a slot is defined therebetween. The mounting beam may be stamped to define a generally U-shape, with a mounting arm extending from the base and a latch arm extending back toward the base from the mounting arm. The bight of the U-shaped mounting beam defines the end thereof most distant from the base of the terminal. The deflectable latch arm may be cantilevered from the bight of the U-shaped mounting beam to extend into and define a portion of the slot between the mounting beam and the contact beam. The free end of the latch arm may extend into the slot between the mounting beam and the contact beam to define a latch for lockingly engaging the internally disposed latch wall in the edge connector housing. The latch arm is deflectable about the bight and will deflect upon insertion of the terminal into the associated terminal receiving cavity of the edge connector housing. However, the latch arm will biasingly return to its undeflected condition when the free end of the latch arm passes the latch wall in the terminal receiving cavity of the edge connector housing. Upon returning to its undeflected condition, the free end of the latch arm will securely retain the terminal within the terminal receiving cavity of the edge connector housing. It will be noted that the locking engagement between the latch arm of the terminal and the latch wall of the edge connector housing is not disposed adjacent an external wall of the edge connector housing. As a result, this primary retention means of the terminal within the edge connector housing will not cause a bowing of the edge connector housing even when the terminals are disposed at a close spacing of approximately 0.050 inch.

A small amount of force fit engagement of the terminal within the edge connector housing may be tolerated depending upon the spacing of the terminals and the plastic material from which the edge connector housing is molded. For example, the arcuate bight at the leading end of the mounting beam can be employed to guide the terminal into a terminal receiving cavity of the edge connector housing having a width equal to or slightly less than the overall width defined by the mounting beam and the contact beam of the terminal. The primary engagement of the terminal with the edge connector housing will be at the internally disposed latch wall. Thus, the terminals and the housing can be designed for lower cantilevered biasing forces between the mounting beam and the external walls of the edge connector housing than would be required if this force fit were the primary means for engaging the terminals within the housing. Furthermore, the stamped configuration of each terminal can be such that the mounting arm of the mounting beam will have a small dimension that will not readily develop sufficient forces to bow the external walls of the edge connector housing outwardly.

The edge connector housing may be constructed such that the terminals are urged upwardly through the bottom portion of the respective terminal receiving cavities therein. More particularly, each terminal may be urged into the corresponding terminal receiving cavity such that the contact beam is disposed on one side of the latch wall and such that the mounting beam is disposed on the other side. The latch arm of the mounting beam will resiliently deflect about the bight of the U-shaped mounting beam and away from the contact beam in response to forces exerted as the terminal moves against the latch wall. However, the terminal will be dimensioned to permit a slight amount of overtravel such that the latch arm will resiliently return to its undeflected condition, and such that the free end of the latch arm will lockingly engage the top surface of the latch wall. The dimensions of the terminal and the terminal receiving cavity ensure that the mounting beam is tightly retained against the outer wall of the edge connector housing. Additionally, in certain embodiments, the relative dimensions of the terminal and the terminal receiving cavity may cause the mounting arm of the mounting beam to be biased slightly toward the contact beam to further ensure a tight mounting engagement of the terminal in the edge connector housing.

The terminal and the edge connector housing are constructed such that the solder tail or other such connecting structure extends below the edge connector housing. Typically, the solder tails will be disposed to extend through holes in a printed circuit board to which the edge connector housing is mounted. The edge connector housing may comprise standoffs to permit and facilitate soldering of the solder tails to the conductive portions on the printed circuit board to which the edge connector is mounted.

The physical mounting of the edge connector housing to the circuit board may be carried out by resiliently deflectable pegs which are engageable with corresponding mounting apertures in the circuit board. At least one peg may comprise a pair of spaced apart latches which are deflectable toward one another upon insertion of the peg into the aperture on the printed circuit board. The pegs provide temporary retention prior to wave soldering. The pegs are slightly longer than the printed circuit board tails. This feature will serve to position the connector relative to the printed circuit board for proper orientation and easy terminal lead in. The locking surface of each peg latch may be angularly aligned to the plane of the printed circuit board to account for dimensional variations in the thickness of the circuit board to which the edge connector is mounted. Additionally, the pegs may be constructed to deflect in directions that are angularly aligned to one another to account for variations in the location of the mounting apertures in the printed circuit board. For example, one peg may include portions which deflect in directions transverse to the length of the edge connector, while the other peg may include portions that deflect in directions parallel to the length of the edge connector. Thus, the edge connector can accommodate variations in mounting aperture location, thereby preventing a bowing of the printed circuit board that could otherwise occur with a circuit board having improperly positioned mounting apertures.

DETAILED DESCRIPTION OF THE PREFERRED EMBODIMENTS

Figure 1:
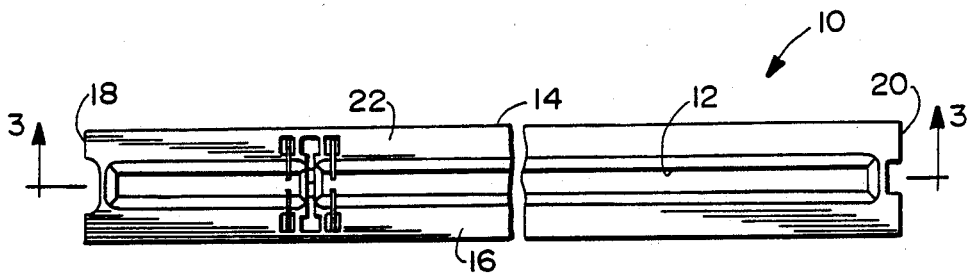
FIG. 1 is a top plan view of the edge connector housing of the subject invention.
Figure 2:
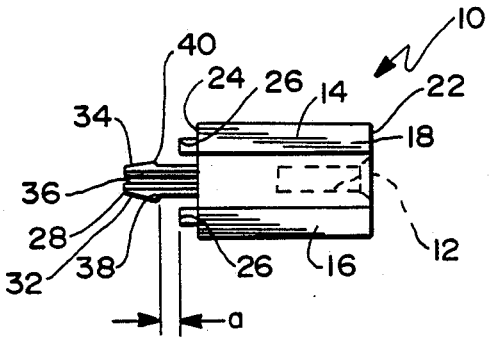
FIG. 2 is an end view of the housing shown in FIG. 1.
Figure 3:
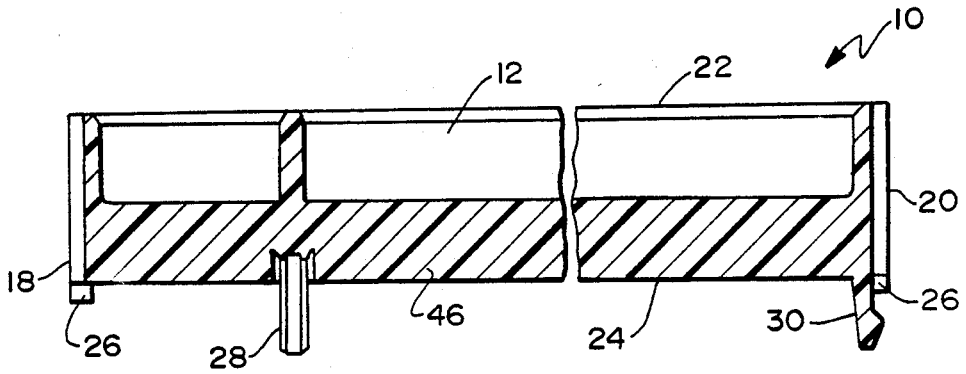
FIG. 3 is a cross-sectional view taken along line 3—3 in FIG. 1.

The edge connector housing of the subject invention is identified generally by the numeral 10 in FIGS. 1–4. The housing 10 is of elongated generally rectangular configuration, and is unitarily molded from a plastic material. More particularly, the housing 10 comprises a card receiving slot 12 centrally disposed therein and aligned generally with the direction of elongation of the housing 10. The slot 12 is dimensioned to receive an edge of a circuit card (not shown), and for making electrical connection to conductive portions disposed along the edge of the circuit card. As noted above, the circuit card inserted into the slot 12 of the edge connector housing 10 may comprise conductive portions disposed at center-to-center spacings of 0.050 inch.

The edge connector housing 10 comprises opposed external side walls 14 and 16 which are spaced from one another and define opposite sides of the elongated card receiving slot 12. The housing 10 further comprises opposed longitudinal ends 18 and 20, a top 22 and a bottom 24. The top 22 of the housing 10 defines the portion thereof into which the slot 12 extends. The bottom 24 of the housing 10 defines the portion thereof that will be mounted to a printed circuit board or other similar supporting structure. The bottom 24 of the edge connector housing 10 is characterized by a plurality of stand off legs 26 which enable the bottom surface 24 of the edge connector housing 10 to be in spaced relationship to the printed circuit board on which the housing 10 is mounted. The spaced relationship achieved by the stand off legs 26 facilitates the soldering, washing and application of conformal coating that may be carried out in association with the mounting of the edge connector housing 10 and the terminals thereof to a printed circuit board.

The bottom 24 of the edge connector housing 10 is further characterized by mounting pegs 28 and 30 extending therefrom and disposed to be received in mounting apertures on the printed circuit board. More particularly, the mounting peg 28 is defined by deflectable mounting legs 32 and 34 having a slot 36 disposed therebetween. The slot 36 extends upwardly from the bottom end of the peg 28 and is oriented such that the deflectable legs 32 and 34 thereof can deflect toward and away from a central longitudinal plane extending through the edge connector housing 10. The mounting legs 32 and 34 are characterized by ledges 38 and 40 which are angularly aligned to the central plane extending through the edge connector housing 10. The distance "a" between the ledges 38 or 40 and the stand off legs 26 substantially corresponds to the thickness of the printed circuit board to which the edge connector housing 10 is mountable. However, the angular alignment of the ledges 38 and 40 enables a secure mounting of the housing 10 to a printed circuit board despite variations in the thicknesses of the printed circuit board. This reliably secure mounting eliminates the need to use fixtures or weights to hold a housing to a circuit board during soldering processes.

The mounting peg 30 is similar in construction to the legs 32 and 34 of the mounting peg 28. However, the mounting peg 30 is oriented to deflect in a direction disposed substantially at a 90° angle to the deflection of the legs 32 and 34. This angular orientation of the mounting pegs 28 and 30 and the respective deflections thereof ensures a secure mounting despite any inaccuracies that may exist in the location of the mounting apertures in the printed circuit board. In this manner, bowing of the printed circuit board that might otherwise be caused by inaccurately located mounting apertures is avoided. Similarly, inaccuracies in the location of mounting apertures also could create forces on the edge connector housing. Many edge connector housings are made from a brittle material. The prior art brittle edge connector housings could crack or break in response to such forces. However, the mounting structure of the subject edge connector housing 10 compensates for inaccurate mounting hole locations, and thereby avoids damage even when the housing 10 is molded from a brittle material.

Figure 4:
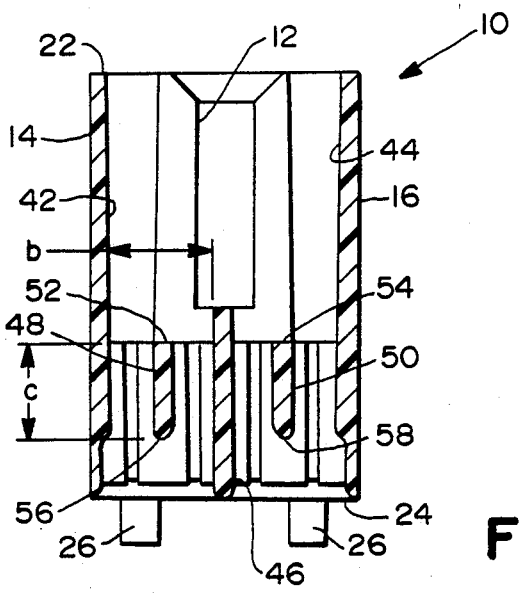
FIG. 4 is a cross-sectional view taken along line 4—4 in FIG. 1.

As shown in FIG. 4, the housing 10 comprises a plurality of terminal receiving cavities 42 and 44 between the top and bottom 22 and 24 of the housing 10. More particularly, the cavities 42 and 44 are disposed on opposite sides of a central wall 46 which extends between the bottom 24 of the housing 10 and the bottom of the slot 12 thereof. Thus, the housing 10 enables double sided connection to a card edge inserted into the slot 12. In particular, the terminal receiving cavity 42 is disposed intermediate the side wall 14 and the central wall 46, while the terminal receiving cavity 44 is disposed between the side wall 16 and the central wall 46 of the housing 10. The width of each cavity 42, 44 is indicated by dimension "b" in FIG. 4.

The terminal receiving cavities 42 and 44 are further characterized by latch walls 48 and 50 respectively. In particular, the latch wall 48 is disposed intermediate the side wall 14 of the housing 10 and the central wall 46, while the latch wall 50 is disposed between the central wall 46 and the side wall 16. The latch walls 48 and 50 comprise respective latch surfaces 52 and 54 disposed on the uppermost portions thereof and bottom cam surfaces 56 and 58. The height of each latch wall 48 and 50 is indicated by dimension "c" in FIG. 4. In the illustrated construction, there are four rails in the terminal receiving cavities. This will allow an accurate position of the terminal on the close centerlines and increase the strength of the mold cores used to create the openings. This contrasts with the prior art designs where injection pressures cause thin rectangular cores to deflect during the molding process, with possible breakage resulting in serious damage to the mold.

Figure 5:
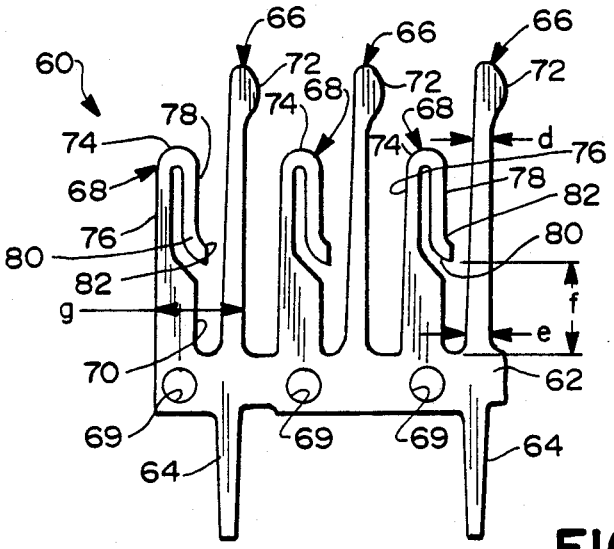
FIG. 5 is a top plan view of a terminal for use in the edge connector housing shown in FIGS. 1–4.

The terminal for placement in the cavities 42 or 44 is illustrated in FIG. 5 and is identified generally by the numeral 60. A plurality of terminals 60 are stamped from a flat strip of metal, with each terminal 60 comprising a base 62 and a solder tail 64 extending therefrom. The solder tail 64 is depicted in FIG. 5 as extending generally linearly from the base 62. However, nonlinear orientations of solder tails on certain terminals typically will be provided to ensure that the holes in the circuit board through which the solder tails 64 extend are not disposed in a single straight line. Rather, the solder tails and the associated holes in the circuit board are staggered to avoid excessive weakening of the printed circuit board. The solder tails also are tapered to provide greater strength and an improved lead in with a greater relative target area for mating to the board.

The terminal 60 further comprises a contact beam 66 and a mounting beam 68 disposed in spaced generally parallel relationship and cantilevered from the side of the base 62 opposite the solder tail 64. A pilot hole 69 extends through the base 62 generally in line with the mounting beam 68. This construction can achieve very substantial material savings as compared to prior art terminals which dispose the pilot hole in a scrap section between terminals. However, the disposition of the pilot hole 69 as shown has no significant effect on the mechanical strength or current carrying capacity or general performance of the terminal 60. The spaced apart orientation of the contact beam 66 and the mounting beam 68 defines a slot 70 therebetween.

The contact beam 66 comprises an arcuate contact edge 72 which is plated with gold or other suitable material and is dimensioned and disposed to lie within the card receiving slot 12 of the housing 10. As will be shown and described further below, the arcuate convex configuration and the location of the contact edge 72 ensures that the gold plated contact edge 72 will achieve a wiping contact with a conductive portion of a circuit card inserted into the slot of the edge connector housing, thereby causing the contact beam 66 to deflect and exert a strong contact force against the conductive portion of the circuit card. The contact beam 66 is tapered along its length such that the width "d" adjacent the contact edge 72 is approximately one-half the width "e" adjacent the base 62. The tapered configuration achieves desirable deflection with low bending stress adjacent the base 62 as explained below.

The mounting beam 68 is stamped in a generally U-shape with a bight 74 defining the end of the mounting beam 68 most distant from the base 62. More particularly, the mounting beam 68 comprises a mounting arm 76 which extends generally between the base 62 and the bight 74, and a latch arm 78 which is deflectively cantilevered from the bight 74. The free end of the latch arm 78 defines a latch surface 80 which is aligned generally orthogonal to the contact beam 66 and the mounting beam 68, and which is disposed to lie generally within the slot 70 therebetween. Portions of the latch arm 78 generally adjacent the latch surface 80 thereof and intermediate the latch surface 80 and the bight 74 define an arcuate convex cam surface 82 which extends into and defines a portion of the slot 70 between the contact beam 66 and the mounting beam 68. More particularly, the cam surface 82 is disposed to deflect the latch arm 78 about the bight 74 upon contact with the bottom cam surface 56 of the latch wall 48 of the housing 10 described and illustrated above. The distance between the latch surface 80 and the base 62 is defined by dimension "f" in FIG. 4. The maximum width defined between the mounting beam 68 and portions of the contact beam 66 is defined by dimension "g" in FIG. 4.

Figure 6:
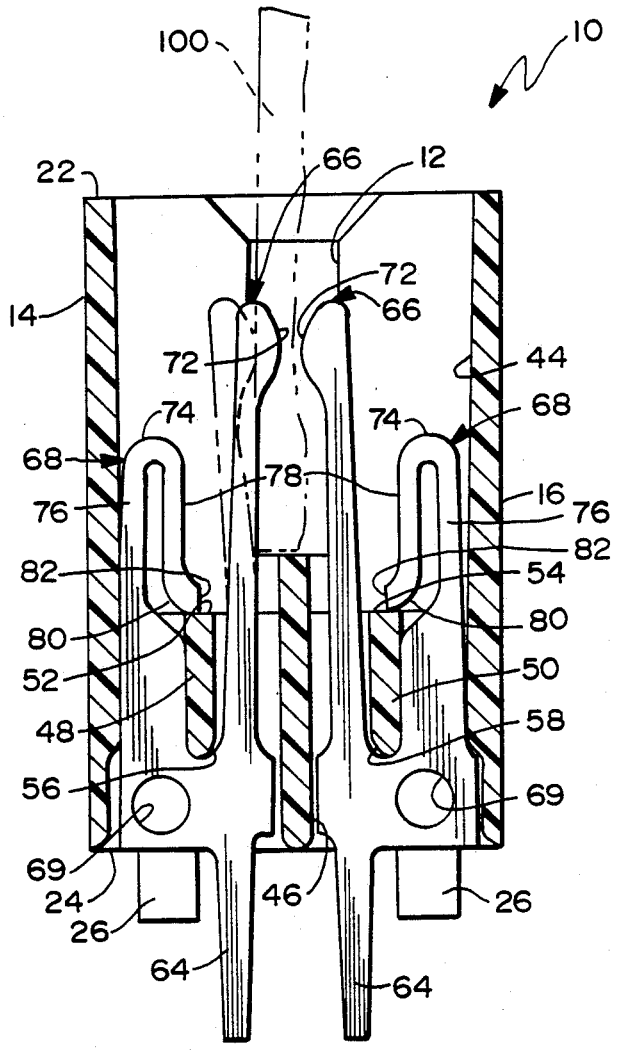
FIG. 6 is a cross-sectional view similar to FIG. 4 but showing the terminal mounted therein.

The terminal 60 depicted in FIG. 5 is mounted into the edge connector housing 10 shown in FIGS. 1–4 by urging the terminal 60 upwardly into the cavity 42, 44 as shown in FIG. 6. More particularly, the terminal 60 is urged into the appropriate cavity 42, 44 such that the contact beam 66 thereof passes intermediate the center wall 46 and the latch wall 48, 50. Additionally, the arcuate leading bight portion 74 of the mounting beam 68 is urged into the space intermediate the outer wall 14, 16 and the latch wall 48, 50. The width of the terminal, as indicated by dimension "g" in FIG. 5 and the width of the cavity 42, 50 as indicated by dimension "b" in FIG. 4 may be selected to achieve a slight force fitting of the terminal 60 within the associated cavity 42, 44. Thus, dimension "g" is equal to or slightly greater than dimension "b". The initial movement of the contact beam 66 into the large open portion at the bottom of cavity 44 is readily carried out by inserting apparatus with no rubbing of the contact edge 72 against the center wall 46 that could damage the gold plating on the contact edge 72. Further movement of the terminal 60 into the cavity 44 is positively guided by the mounting beam 68 to further prevent rubbing of the contact edge 72.

Continued insertion of the terminal 60 into the cavity 42, 44 will urge the camming surface 82 of the latch arm 78 on mounting beam 68 into camming engagement with the lowermost cam surface 56, 58 of the latch wall 48, 50, thereby causing the latch arm 78 to resiliently deflect about the bight portion 74 of the mounting beam 68. The dimension "f" between the latch surface 80 and the base 62 of the terminal 60 is slightly greater than the height "c" of the latch wall 48, 50 to achieve a slight amount of overtravel of the latch surface 80 of terminal 60 relative to the latch surface 52, 54 of the latch wall 48, 50. As a result, upon complete insertion of the terminal 60 into the cavity 42, 44, the latch arm 70 will resiliently return to its undeflected condition and the latch surface 80 thereof will lockingly engage the latch surface 52, 54 of the latch wall 48, 50. This locking engagement of the mounting beam 68 to the housing 10 exerts no pressure on the external walls 14, 16 of the housing 10. Additionally, the terminal 60 can be manufactured such that the width "g" substantially equals or is only slightly greater than the width "b" of the cavity 42, 44, thereby ensuring that either no force or minimal forces are exerted on the external walls 14, 16. As a result of this construction, the bowing of the edge connector housing 10 can be substantially eliminated or reduced to an acceptable minimum.

The construction of both the terminal 60 and the housing 10 ensures that the deflection of the contact beam 60 upon insertion of the card into the slot 12 of the housing 10 is entirely independent of the means for retaining the terminal 60 in the housing 10. Additionally, as shown in FIG. 6, the contact beam 66 is in a free floating condition prior to insertion of a circuit card into the slot 12. Thus, there is no preload of the contact beam 66 toward the slot as is common with prior art edge connectors. This free floating condition of the contact beam 66 results in very low initial forces on the contact edge 72 as the card is inserted into the slot 12, thereby substantially minimizing the chance of damage to the gold plating on the contact edge 72.

FIG. 6 also shows the edge connector 10 with a circuit card 100 inserted into the slot 12. It will be noted that the contact beam 66 deflects such that the gold plated contact edge exerts a biasing contact force against a conductive portion of the card 100 to achieve a high quality electrical connection. It will be noted that the tapered configuration of the contact beam 66 results in a gradual deflection along its length and with no concentration of bending stress. This is in contrast to the prior art constant width contact beams which tend to concentrate bending stress adjacent the base from which the beam is cantilevered.

The housing 10 with the terminals mounted therein is mounted to a printed circuit board such that the solder tails 64 of each terminal 60 extend through holes in the printed circuit board. Additionally, the mounting pegs 28 and 30 are urged into mounting apertures in the printed circuit board. As noted above, the construction and orientation of the mounting pegs 28 and 30 enables the edge connector housing 10 to self adjust for inaccuracies in both the thickness of the printed circuit board and the relative positions of the mounting apertures therein.

While the invention has been described with respect to a preferred embodiment, it is apparent that changes can be made without departing from the scope of the invention as defined by the appended claims.

I claim:

1. An edge connector comprising a nonconductive housing having a pair of opposed external side walls, a top and a bottom, a slot extending into said top and dimensioned to receive an edge of a circuit card, a center wall intermediate the opposed external side walls, a plurality of terminal receiving cavities extending into the bottom of said housing and extending to said slot, each said terminal receiving cavity being disposed intermediate the center wall and one of said side walls and comprising a latch wall having a top and a bottom, each said latch wall being spaced from the external side walls and from the top and the bottom of said housing, said edge connector further comprising a terminal mounted in each said cavity, each said terminal comprising a base dimensioned for mounting in said cavity intermediate the bottom of the latch wall and the bottom of the housing, a connecting means connected to said base of said terminal and extending from said housing for electrically connecting said terminal to a circuit, a resilient deflectable contact beam extending from said base intermediate the center wall and the latch wall and into the slot of said housing, and a resilient deflectable mounting beam extending from said base and extending intermediate one said external side wall of said housing and the latch wall of said cavity, said mounting beam comprising a generally U-shaped portion comprising a mounting arm and a latch arm connected to one another at a bight, the bight defining the location on said mounting beam most distant from said base of said terminal, the mounting arm of said mounting beam being adjacent the external side wall of said cavity, and the latch arm of said mounting beam being lockingly engaged with the top of the latch wall of said cavity to lockingly retain said terminal in said housing.

2. An edge connector as in claim 1 wherein the connecting means of said terminal defines a solder tail extending from a side of said base generally opposite the contact beam and the mounting beam.

3. An edge connector as in claim 1 wherein the latch arm comprises an end defining the portion thereof most distant from said bight, said end of said latch arm being lockingly engaged with the latch wall of said cavity.

4. An edge connector as in claim 1 wherein the latch arm of said mounting beam comprises a cam surface disposed for engagement with said latch wall for deflecting said latch arm about said bight during insertion of said terminal into said cavity.

5. An edge connector as in claim 1 wherein the bight of said mounting beam defines a generally arcuate leading edge of said mounting beam for guiding said terminal into said cavity.

6. An edge connector as in claim 1 wherein said housing comprises a central wall with said cavities being defined on opposite sides of said central wall, said central wall being spaced from the latch walls of said cavities.

7. An edge connector as in claim 6 wherein the maximum width defined across the contact beam and mounting beam of said terminal exceeds the distance between said external wall and said central wall of said housing by a predetermined amount, such that said terminal achieves a controlled force fit engagement in said cavity.

8. An edge connector as in claim 6 wherein the contact beam is disposed intermediate the central wall and the respective latch wall.

9. An edge connector as in claim 1 wherein said contact beam and said mounting beam are disposed in generally parallel relationship, with a slot therebetween, said latch arm defining one side of said slot.

10. An edge connector as in claim 8 wherein the end of said latch arm most distant from said bight defines the narrowest portion of the slot between said contact beam and said mounting beam.

11. An edge connector as in claim 10 wherein the latch wall of said housing defines a width measured generally orthogonal to said external side wall and said central wall, the minimum distance of said slot defined between said contact beam and the end of said latch arm being less than the width of said latch wall, such that said latch arm is deflected by said latch wall upon insertion of said terminal into said cavity.

12. An edge connector as in claim 1 wherein the bottom of said housing comprises a plurality of deflectable mounting pegs, said mounting pegs being constructed for deflection about angularly aligned axes.

13. An edge connector as in claim 12 wherein the mounting pegs comprise latching ledges angularly aligned to a central plane extending through said housing.

14. An electrical terminal for mounting in an edge connector, said terminal being of generally planar configuration and being stamped from a unitary piece of metallic material and comprising:

a base;

a connecting means extending from said base for connecting said terminal to a selected circuit component;

a contact beam extending from said base and being resiliently deflectable relative thereto, said contact beam comprising a contacting edge at a location thereon spaced from said base said contacting edge formed by the stamping of said unitary piece of metallic material and having a plane perpendicular to the plane of said unitary piece of metallic material; and a mounting beam extending from said base and disposed in spaced relationship to said contact beam, said mounting beam being generally U-shaped and comprising a mounting arm extending unitarily from said base, a bight disposed at an end of said mounting arm remote from said base and a latch arm extending from said bight generally back toward the base, said latch arm being disposed intermediate the mounting arm and the contact beam, said latch arm being resiliently deflectable about said bight and defining a latch surface at a location thereon spaced from both said bight and said base.

15. A terminal as in claim 14 wherein said bight defines a generally arcuate leading surface of said mounting beam for guiding the terminal into a housing.

16. A terminal as in claim 14 wherein the mounting beam and the contact beam are disposed in generally parallel relationship to one another.

17. A terminal as in claim 16 wherein the latch arm comprises a latch surface disposed on said latch arm at a location thereon remote from said bight, said latch surface being aligned generally orthogonal to the parallel mounting beam and contact beam of said terminal.

18. A terminal as in claim 17 wherein said latch arm comprises a cam surface intermediate the latch surface and the bight, and disposed on a side of said latch arm generally facing the contact beam.

19. A terminal as in claim 18 wherein the cam surface is generally convexly arcuate and defines the portion of said latch arm closest to said contact beam.

20. An edge connector as in claim 1 wherein said terminal is stamped from a unitary piece of metallic material and is of planar configuration.

* * * * *